US005678471A

United States Patent [19]

Ash, Jr. et al.

[11] Patent Number: 5,678,471

[45] Date of Patent: Oct. 21, 1997

[54] SWASHPLATE PUMP INCORPORATING A DUAL LOCATION CLUSTER BEARING

[75] Inventors: Robert Henry Ash, Jr., Humble; Brian Michael Chrestoff, Magnolia, both of Tex.

[73] Assignee: FMC Corporation, Chicago, Ill.

[21] Appl. No.: 636,371

[22] Filed: Apr. 23, 1996

[51] Int. Cl.[6] ..... F01B 3/00

[52] U.S. Cl. ..... 92/71; 417/269; 91/499; 74/60

[58] Field of Search ..... 92/57, 71; 417/269; 91/499; 74/60

[56] References Cited

U.S. PATENT DOCUMENTS

| | | | |
|---|---|---|---|
| 3,221,564 | 12/1965 | Raymond | 417/269 |
| 3,249,052 | 5/1966 | Karlak | 92/71 |
| 4,741,251 | 5/1988 | Hayashi et al. | 91/499 |
| 5,013,219 | 5/1991 | Hicks et al. | 417/269 |
| 5,046,403 | 9/1991 | Riedhammer | 92/57 |

*Primary Examiner*—Thomas E. Denion

[57] ABSTRACT

A swashplate style pump uses a dual location cluster bearing of consistent configuration for use in each of two positions in the pump. In one location the dual location cluster bearing will interface with pistons and the swashplate cam. In a second location the dual position cluster bearing will interface with the non-camming side of the swashplate and the back plate of the pump. The dual position cluster bearing can be used in either and both positions with equal facility.

6 Claims, 2 Drawing Sheets

SWASHPLATE PUMP INCORPORATING A DUAL LOCATION CLUSTER BEARING

BACKGROUND OF THE INVENTION

1. Field of the Invention

This invention has to do with swashplate pumps and specifically with a dual location and dual purpose cluster bearing that in one position in the pump acts as a bearing between the relative bottom surface of the pump swashplate and in a second position in the pump as a cam follower interfaced between the pistons of the pump and the inclined swashplate drive cam. The dual location cluster bearing is formed as a single piece of non-metallic material replacing multiple cam thrust bearings and a multi-part cam follower in the prior art.

2. Description of the Prior Art

Swashplate pumps have been in use in the fluid pumping field for many years. They are typically used in pumping fluids wherein a non-pulsed output stream is desired. This style of pump is efficient and does not have the pumping losses sometimes inherent in pumps of other designs. The closest prior art to the invention presented herein is the "Delpump" formerly manufactured by CHPT Incorporated as disclosed further on in this specification.

A cluster bearing of the type used in this invention is disclosed in pending U.S. application Ser. No. 08/611,315.

SUMMARY OF THE INVENTION

As stated above, the invention resides in an improvement to swashplate pumps and specifically those swashplate pumps with multiple components used in making up the bearing surfaces between the pistons of the pump and the inclined swashplate drive cam in one location and the relative bottom of the swashplate and the pump housing on the other hand. The dual location cluster bearing used in the invention presented herein is formed from a single piece of non-metallic material replacing multiple multi-part cam followers and cam thrust bearings in the prior art. In a first location in the swashplate pump the dual location cluster bearing includes a surface that will receive the arcuate ends of the pistons of the pump and the obverse surface will include bearing surfaces that transmit the load from the inclined cam surface of the swashplate to the pump pistons. The second location for use of the dual location cluster bearing is at the bearing surface between the swashplate and the housing of the pump. This is primarily a generally flat surface and the portions of the cluster bearing that would normally receive the ends of the pistons will be located in a groove, channel or recess formed in the inboard surface of the housing or back plate below the swashplate thrust zone. The second cluster bearing is generally upside down relative to the first cluster bearing.

An advantage of the dual location cluster bearing is that it will be used in either of two places in the host swashplate pump. It is one piece part that has two separate uses in the pump. By its unique shape it can be used with equal facility in either of the two locations thereby eliminating the need for separate bearing assemblies for each location.

BRIEF DESCRIPTION OF THE DRAWINGS

The invention is graphically presented by several drawing figures including the following figures.

DESCRIPTION OF THE PREFERRED EMBODIMENT

Swashplate pumps of the type incorporating the invention set forth herein are well known in the industry. The specific pump to which this improvement applies is FMC Corporation's "Series C Composite Piston Pumps" previously manufactured under the trademark Delpump by CHPT Incorporated. U.S. Pat. No. 5,013,219 applies to this pump. The pump is described in literature available from FMC in Houston, Tex.

Figure 1:
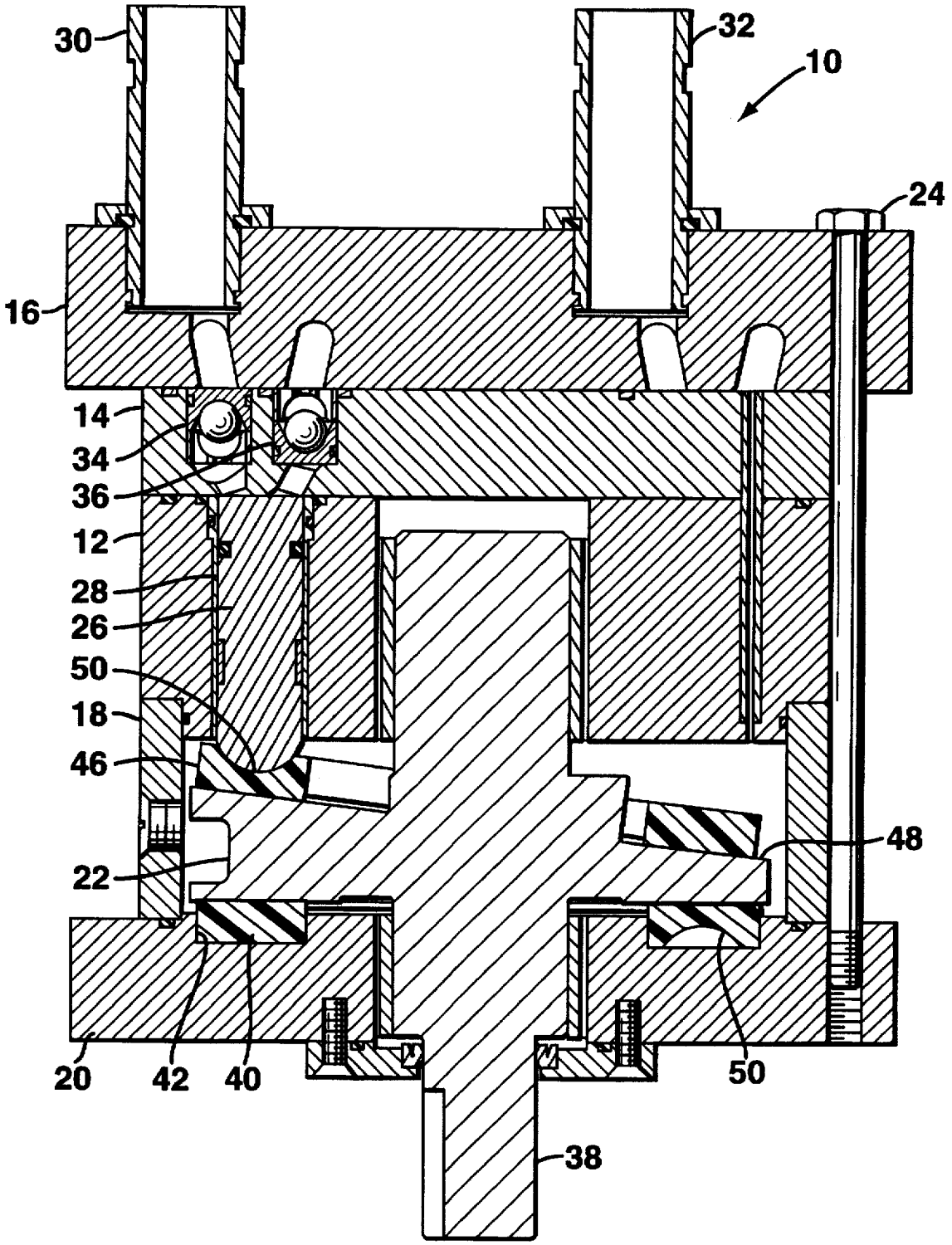
FIG. 1 is a cross sectional view of a swashplate pump incorporating the invention.

Looking at FIG. 1, a sectional view of a swashplate pump, generally 10, is shown. A body 12 is capped with a check valve housing 14 which in turn is capped with a gallery 16. A cam spacer 18 supports the body 12 away from back plate 20 providing a cavity for the cam subassembly or swashplate 22. Hex nuts such as 24 will clamp the gallery 16, check valve assembly 14, body 12, cam spacers 18 and the back plate together as shown in FIG. 1.

A piston 26, one of several, generally between five and twelve in number depending on pump capacity, which in used in a pump of this type is carried in a lined cylinder 28 in the body 12. This piston 26 will be urged to travel reciprocally in the lined cylinder 28 by the well known principal of the camming action of the swashplate design pump. Fluid to be pumped will enter the pump 10 through inlet fitting 30 and be pumped out of the outlet fitting 32. Check valves such as 34 and 36, one set of check valves associated with one each of said pistons 26, will control flow of the pumped fluid into and out of the pump.

The cam 22 includes an extended portion 38 which is the mechanical drive input shaft for rotating the integral cam 22 and shaft assembly.

Figure 2:
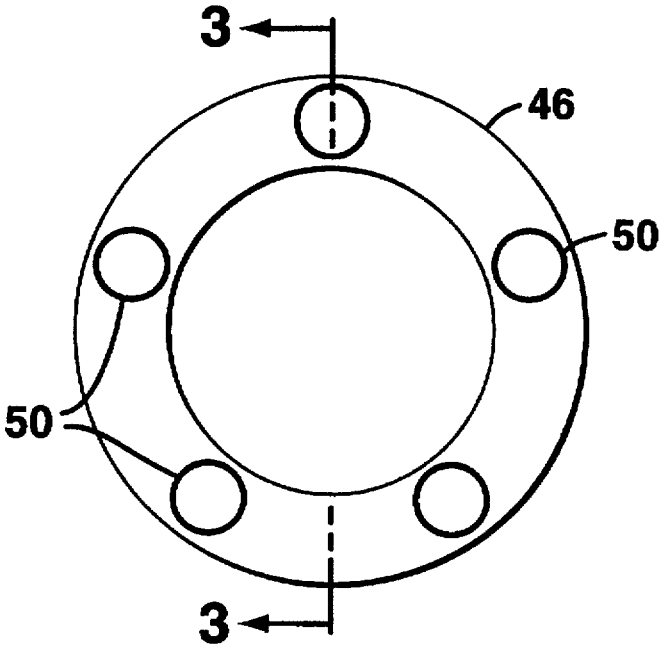
FIG. 2 is a top view of the dual location cluster bearing.
Figure 3:
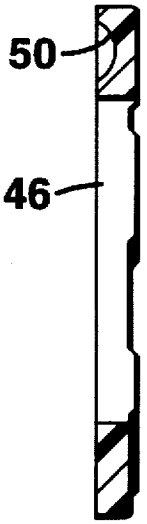
FIG. 3 is a view of the dual location cluster bearing taken through 3—3 of FIG. 2.

The first location for the two dual position cluster bearings 46 in the swashplate pump is between the piston 26, actually the arcuate end portion of the piston, and the flat cam surface 48 of the cam 22. The cluster bearings, one shown as 40 and the second one shown as 46, as shown in the sectional view of FIG. 1 are shown removed from the pump in FIGS. 2, 3, and 4. The dual position cluster bearing from the piston contacting location has been selected as the one that the drawing figures are based on.

The second place that the dual position cluster bearing, a cluster bearing shown as 40, is used in this swashplate pump is between the back plate 20 and the relative bottom side of the swashplate 22. In FIG. 1 the back plate 20 is shown with a cavity such as 42. This cavity can be a circumferential groove or channel machined or otherwise formed in the inboard surface of the back plate 20. The channel 42 is circumferential around the center of the pump relative to the major axis of the swashplate drive shaft.

In these figures the cluster bearing is shown with the piston receiving bearing cups, such as 50, which are concave receivers which accommodate the arcuate ends of the pistons 26. Five piston receiving bearing cups 50 are shown in the cluster bearing 46 of FIG. 2; however, this number is dependent on pistons and the pump and would normally be between five and twelve in today's production pumps. The bearing cups 50 are formed integrally into a web of material and the piston cups, indentations in the web, are axially spaced around the web.

Figure 4:
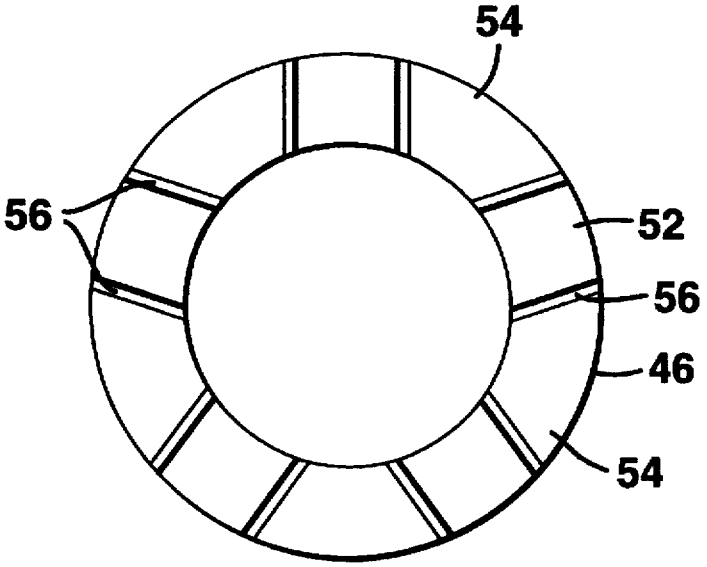
FIG. 4 is the obverse side of the dual location cluster bearing shown in FIG. 2.

The obverse side (from FIG. 2) of the cluster bearing 46 is shown in FIG. 4. In this figure items such as 52, there are five shown, are thrust bearing surfaces which are generally "under" and aligned with the piston receiving bearing cups 50. They will provide thrust bearing surfaces that ride proximate to the flat cam surface 48 of the cam 22. When the dual position cluster bearing is in the position between the back plate and the relative bottom of the swashplate these thrust bearing surfaces will contact the swashplate. When in the piston contacting position these thrust bearing pads or surfaces 52 will absorb the discharge and suction pressure load on the pistons. They will ride on the inclined surface of the rotating cam and will be lubricated with a naturally forming hydrodynamic film of water or other liquid to separate the surface of the cluster bearing from the surface of the rotating cam. The preferred material for the single piece injection molded dual location cluster ring is Arlon 1555 PEEK. If the lubrication between contact surfaces of the dual location cluster bearing and cam experience a drop in viscosity or transient load conditions that create contact between the dual location cluster bearing 46 and the cam surface 48, the carbon filled PEEK cluster bearing will provide lubrication.

On the obverse side of the cluster bearing the areas between the thrust bearing surface pads 52, the relief zones such as 54, are relatively lower than the thrust bearing surfaces 52. A slight ramp, such as 56 is formed to transition between the relief zones 54 and the thrust bearing surface pads 52 on both sides of the pads.

The inventors contemplate that the method of assembling a swashplate type pump in which this dual location cluster bearing will be used will be, in pertinent part, as follows. The swashplate style pump will include a pump having a back plate with a bearing receiving channel formed into it and a swashplate having a camming surface and a non-camming surface. As is common practice, multiple pistons will be carried adjacent the camming surface of said swashplate. The steps of the method of assembling the pump will include selecting a first cluster bearing from a set of cluster bearings for installation in said swashplate pump, installing the selected first cluster bearing in a position in the pump between the camming surface of the swashplate and the pistons, selecting a second cluster bearing from a set of cluster bearings for installation in the swashplate pump, and then installing the selected second cluster bearing in a position in the pump between the non-camming surface of the swashplate and the back plate of the pump. The set of dual location cluster bearings will include, in a preferred embodiment, a collection of interchangeable dual location cluster bearings.

In summary the invention presented herein is for use in a swashplate type pump. The pump includes a back plate and a swashplate with the swashplate having a camming surface and a non-camming surface and multiple pistons carried adjacent the camming surface of the swashplate. The improvement over the art includes a first cluster bearing located between the camming surface of the swashplate and the pistons. This first cluster bearing has a plurality of piston receiving bearing cups and a plurality of thrust bearing surfaces on the side of the cluster bearing obverse from the side in which the piston receiving bearing cups are formed. A second cluster bearing is located between the non-camming surface of the swashplate and the back plate of the pump. This second cluster bearing has a plurality of piston receiving bearing cups and a plurality of thrust bearing surfaces on the side of the cluster bearing obverse from the side in which the piston receiving bearing cups are formed just like the first cluster bearing. The point of the invention is that each of these two bearings come from the same set of bearings and can be used in either position with equal facility.

It is believed that the foregoing explanation and description, when read in juxtaposition with a review of the drawing figures, of the invention provides a full teaching of the invention. The inventors recognize that design changing the cluster bearing are possible, such as the use of different material having similar properties to the preferred material herein. It is expected that the following claims will cover such nuances of design and product selection.

What is claimed is:

1. A swashplate type pump, said pump including a back plate with a bearing receiving channel and a swashplate, said swashplate having a camming surface and a non-camming surface, multiple pistons carried adjacent said camming surface of said swashplate, the improvement comprising:

a first cluster bearing located between said camming surface of said swashplate and said pistons, said first cluster bearing having a plurality of piston receiving bearing cups and a plurality of thrust bearing surfaces on the side of the cluster bearing obverse from the side in which the piston receiving bearing cups are formed;

a second cluster bearing located between said non-camming surface of said swashplate and said back plate of said pump, said second cluster bearing having a plurality of piston receiving bearing cups and a plurality of thrust bearing surfaces on the side of the cluster bearing obverse from the side in which the piston receiving bearing cups are formed.

2. The invention in accordance with claim 1 wherein said second cluster bearing is positioned in said bearing receiving channel with said thrust bearing surfaces contacting said non-camming surface of said swashplate.

3. The invention in accordance with claim 1 wherein said second cluster bearing is positioned in said bearing receiving channel with said piston receiving bearing cups contacting said non-camming surface of said swashplate.

4. The invention in accordance with claim 2 wherein each of said first and said second cluster bearings are interchangeable.

5. The invention in accordance with claim 4 wherein said first cluster bearing thrust bearing surfaces will contact said camming surface of said swashplate and said second cluster bearing thrust bearing surfaces will contact said non-camming surface of said swashplate.

6. A method of assembling a swashplate type pump, said pump including a back plate and a swashplate, said swashplate having a camming surface and a non-camming surface, multiple pistons carried adjacent said camming surface of said swashplate, comprising the steps of:

selecting a first cluster bearing from a set of cluster bearings for installation in said swashplate pump;

installing said selected first cluster bearing in a position in said pump between said camming surface of said swashplate and said pistons;

selecting a second cluster bearing from a set of cluster bearings for installation in said swashplate pump;

installing said selected second cluster bearing in a position in said pump between said non-camming surface of said swashplate and said back plate of said pump;

wherein said set of cluster bearings from which said first cluster bearing is selected is the same set of cluster bearings from which said second cluster bearing is selected;

wherein said cluster bearings of said set of cluster bearings have a plurality of piston receiving bearing cups and a plurality of thrust bearing surfaces on the side of the cluster bearing obverse from the side in which the piston receiving bearing cups are formed.

* * * * *